US005575829A

United States Patent [19]

Kundrat

[11] Patent Number: 5,575,829

[45] Date of Patent: Nov. 19, 1996

[54] DIRECT USE OF SULFUR-BEARING NICKEL CONCENTRATE IN MAKING NI ALLOYED STAINLESS STEEL

[75] Inventor: David M. Kundrat, Cincinnati, Ohio

[73] Assignee: Armco Inc., Middletown, Ohio

[21] Appl. No.: 470,308

[22] Filed: Jun. 6, 1995

[51] Int. Cl.[6] ..... C21C 5/52

[52] U.S. Cl. ..... 75/10.35; 75/10.42; 75/10.45; 75/501; 75/540; 75/546

[58] Field of Search ..... 75/10.35, 10.42, 75/10.45, 10.46, 10.47, 10.58, 501, 540, 541, 546, 558

[56] References Cited

U.S. PATENT DOCUMENTS

| | | | |
|---|---|---|---|
| 3,947,267 | 3/1976 | d'Entremont et al. | 75/10.42 |
| 4,069,039 | 1/1978 | Lehman | 75/10.46 |
| 4,531,974 | 7/1985 | Kos | 75/10.46 |
| 4,551,173 | 11/1985 | Nakashima et al. | 75/10.45 |
| 4,551,174 | 11/1985 | Nakashima et al. | 75/10.45 |
| 4,650,517 | 3/1987 | Hasegawa et al. | 75/10.45 |
| 4,695,318 | 9/1987 | Knauss et al. | 75/558 |
| 4,971,622 | 11/1990 | Slatter | 75/10.58 |
| 5,039,480 | 8/1991 | Tanabe et al. | 420/588 |
| 5,047,082 | 9/1991 | Tanabe et al. | 75/629 |

FOREIGN PATENT DOCUMENTS

| | | | |
|---|---|---|---|
| 855006 | 8/1981 | U.S.S.R. | 75/10.47 |

*Primary Examiner*—George Wyszomierski
*Attorney, Agent, or Firm*—R. J. Bunyard; L. A. Fillnow; R. H. Johnson

[57] ABSTRACT

A process for obtaining Ni units from sulfur-bearing nickel concentrate during refining a nickel-alloyed steel or a stainless steel. Sulfur of the concentrate is transferred to and held within the slag by controlling slag composition and temperature, degree of mixing of the slag with the bath by an inert gas and aluminum level in the bath. The extent of desulfurization by the slag, the slag weight and the steel sulfur specification determine the amount of concentrate that can be added to the bath. The ratio of the slag weight to the iron bath weight should be in the range of 0.10–0.30 and the bath temperature is maintained between 1550°–1700° C. The slag basicity is controlled between 1.0 and 3.5, the composition of $Al_2O_3$ in the slag is maintained between 15–25 wt. % and the composition of MgO is maintained between 12–20 wt. %.

23 Claims, No Drawings

DIRECT USE OF SULFUR-BEARING NICKEL CONCENTRATE IN MAKING NI ALLOYED STAINLESS STEEL

BACKGROUND OF THE INVENTION

This invention relates to a process for manufacturing iron or steel alloyed with nickel. More particularly, at least some of the Ni alloying units of stainless steels are obtained by the addition of a sulfur-bearing nickel concentrate to molten iron. The process capitalizes on the presence of under-utilized slag present during refining of the iron bath, with the slag being capable of removing and holding sulfur when the bath and slag are vigorously mixed under reducing conditions.

It is known to manufacture nickel-alloyed stainless steel by melting a charge containing one or more of Ni-containing scrap, ferronickel or nickel shot in an electric arc furnace. After melting of the charge is completed, the molten iron is transferred to a refining vessel where the bath is decarburized by stirring with a mixture of oxygen and an inert gas. Additional metallic nickel, ferronickel or shot may be added into the bath to meet the nickel specification.

Ni units contained in scrap are priced about the same as Ni units in ferronickel and constitute the most expensive material for making nickel-alloyed stainless steel. Ni units in ferronickel or nickel shot are expensive owing to high production costs of liberating nickel from ore generally containing less than 3 wt. % Ni. Nickel ores are of two generic types, sulfides and laterites. In sulfur-containing ores, nickel is present mainly as the mineral pentlandite, a nickel-iron sulfide that may also be accompanied with pyrrhotite and chalcopyrite. Sulfur-containing ores typically contain 1–3 wt. % Ni and varying amounts of Cu and Co. Crushing, grinding and froth flotation are used to concentrate the valuable metals and discard as much gangue as possible. Thereafter, selective flotation and magnetic separation can be used to divide the concentrate into nickel-, copper- and iron-rich fractions for further treatment in a pyrometallurgical process. Further concentration of nickel can be obtained by subjecting the concentrate to a roasting process to eliminate up to half of the sulfur while oxidizing iron. The concentrate is smelted at 1200° C. to produce a matte consisting of Ni, Fe, Cu, and S, and the slag is discarded. The matte can be placed in a converter and blown with air to further oxidize iron and sulfur. Upon cooling of the matte, distinct crystals of Ni—Fe sulfide and copper sulfide precipitate separately according to the dictates of the Fe—Cu—Ni—S phase diagram. After crushing and grinding, the sulfide fraction containing the two crystals is separated into copper sulfide and Ni—Fe sulfide concentrates by froth flotation. The Ni—Fe sulfide concentrate undergo several more energy-intensive stages in route to producing ferronickel and nickel shot. The Ni—Fe sulfide can be converted to granular Ni—Fe oxide sinter in a fluidized bed from which a nickel cathode is produced by electrolysis. Alternatively, Ni—Fe concentrates can undergo a conversion to Ni and Fe carbonyls in a chlorination process to decompose into nickel and iron powders.

It is known to produce stainless steel by charging nickel-bearing laterite ore directly into a refining vessel having a top blown oxygen lance and bottom tuyeres for blowing stirring gas. Such ores contain at most 3% Ni, with over 80% of the ore weight converting to slag. U.S. Pat. No. 5,047,082 discloses producing stainless steel in an oxygen converter using a low-sulfur nickel-bearing ore instead of ferronickel to obtain the needed Ni units. The nickel ore is reduced by carbon dissolved in molten iron and char present in the slag. U.S. Pat. No. 5,039,480 discloses producing stainless steel in a converter by sequentially smelting and reducing low sulfur nickel-bearing ore and then chromite ore, instead of ferronickel and ferrochromium. The ores are reduced by carbon dissolved in the molten iron and char present in the slag.

Because laterite ore contains little sulfur, the bulk of Ni units for making stainless steel can come from the ore. However, the large quantity of slag accompanying the Ni units necessitates a separate, energy-intensive smelting step in addition to the refining step, requiring increased processing time and possibly a separate reactor.

Control of bath sulfur content is one of the oldest and broadest concerns during refining of iron. Ever since iron was smelted in the early blast furnaces, it was known that slag in contact with molten iron offered a means for removing some of the sulfur originating from coke used as fuel. More recently, key factors identified for sulfur removal during smelting include controlling slag basicity as a function of partial pressures of gaseous oxygen of the slag and controlling slag temperature.

Nevertheless, the slag sulfur solubility limit normally is not reached during routine refining of stainless steel alloyed with nickel because the total sulfur load in the refining vessel originating from melting the solid charge material in an electric arc furnace is low. Hence, slag desulfurization capacity in the refining vessel is under-utilized. Increased slag weight, the presence of residual reductants in the bath and the manipulation of slag composition can all increase this degree of under-utilization. There also remains a long felt need for lowering the cost of nickel alloying units used in the manufacture of alloyed iron or steel such as nickel-alloyed steel and austenitic stainless steel without the need for major capital expenditure.

BRIEF SUMMARY OF THE INVENTION

This invention relates to a process for manufacturing a nickel-alloyed iron or a stainless steel by deriving at least some of the Ni alloying units of the iron or steel by the addition of a sulfur-bearing nickel concentrate to molten metal. The process capitalizes on the presence of substantial slag weight present during refining of the iron bath with the slag being capable of removing and holding additional sulfur when the bath is vigorously mixed under reducing conditions.

A principal object of the invention is to provide inexpensive Ni units directly from a sulfur-bearing nickel concentrate during the manufacture of a nickel-alloyed steel or a stainless steel.

Another object of the invention is to exploit the under-utilization of slag desulfurization capacity by the direct addition of sulfur-bearing nickel concentrate during the manufacture of a nickel-alloyed steel or a stainless steel.

This invention includes a process for manufacturing a nickel-alloyed iron, steel or a stainless steel in a refining vessel including a bottom tuyere. The process further includes providing an iron-based bath covered by a slag in the refining vessel, the bath including a sulfur-bearing nickel concentrate and a reductant, passing an inert gas through the bottom tuyere to vigorously rinse the bath to intimately mix the concentrate and continue rinsing the bath until maximum transfer of sulfur from the bath to a final slag is achieved and a dynamic equilibrium is approached whereby the bath becomes alloyed with nickel.

Another feature of the invention is for the weight ratio of the final slag weight to the bath weight to be at least 0.1.

Another feature of the invention is for the aforesaid slag to have a basicity of at least 1.0.

Another feature of the invention is for the aforesaid final slag to contain at least 12 wt. % MgO.

Another feature of the invention is for the aforesaid process to include a reduction step of passing oxygen through the tuyere to remove excess carbon from the iron bath prior to rinsing with the inert gas.

Another feature of the invention is for the aforesaid bath to have a temperature at least 1550° C. when rinsing during the reduction step.

Another feature of the invention is for the aforesaid iron bath being alloyed with chromium.

Another feature of the invention is for the aforesaid reductant being one or more of aluminum, silicon, titanium, calcium, magnesium and zirconium; the concentration of the reductant in the nickel-alloyed bath being at least 0.01 wt. %.

Another feature of the invention is for the aforesaid concentrate and reductant to be added to the iron bath in an electric arc furnace.

Another feature of the invention includes the additional steps of adding charge materials to an electric arc furnace, the charge materials including ferrous scrap, the concentrate and one or more slagging agents from the group of CaO, MgO, $Al_2O_3$, $SiO_2$ and $CaF_2$, melting the charge materials to form the iron bath and transferring the iron bath to the vessel.

Another feature of the invention is for the aforesaid nickel-alloyed bath being a stainless steel containing ≦2.0 wt. % Al, ≦2.0 wt. % Si, ≦0.03 wt. % S, ≦26 wt. % Cr and ≦20 wt. % Ni.

An advantage of the invention is to provide a process for providing inexpensive Ni alloying units during the manufacture of nickel-alloyed stainless steel.

The above and other objects, features and advantages of the invention will become apparent upon consideration of the following detailed description.

DETAILED DESCRIPTION OF THE PREFERRED EMBODIMENTS

The present invention relates to using an inexpensive source of nickel for manufacturing nickel-alloyed iron, nickel-alloyed steel or nickel-alloyed stainless steel. This source of nickel is a sulfur-bearing nickel concentrate derived as an intermediate product from hydrometallurgy or from energy-intensive smelting during manufacture of ferronickel and nickel shot, or from beneficiation of raw sulfur-bearing nickel ores. The nickel content of the concentrate produced depends on the ore type and the process employed. A concentrate produced from precipitation of Ni—Fe sulfide from a smelting matte may analyze in wt. %: 16–28% Ni, 35–40% Fe, 30%S <1% Cu and <1% Co. A concentrate produced by a beneficiation process may analyze in wt. %: 9% Ni, 40% Fe, 30%S, 1% Cu, bal. $SiO_2$, $Al_2O_3$, CaO, and MgO. A preferred sulfur-bearing concentrate of the invention is formed from nickel pentlandite ore having $(Fe, Ni)_9S_8$ as the predominant Ni species. If the concentrate is being used for manufacturing stainless steel, the concentrate also may include a source of Cr alloying units as well. Acceptable chromium sources include unreduced chromite concentrate and partially reduced chromite concentrate.

The Ni alloying units available from these concentrates are recovered in a refining vessel. Examples of such a refining vessel include a Top and Bottom blown Refining Reactor (TBRR), an Argon-Oxygen Decarburizer (AOD) or a Vacuum Oxygen Decarburizer (VOD). Regardless of the type of refining vessel, it will be equipped with at least one or more bottom tuyeres, porous plugs, concentric pipes, and the like, hereafter referred to as a tuyere, for passing an inert gas into an iron bath contained within the vessel during the reducing period while refining stainless steel when a reductant is added to the bath to recover Cr units from the slag. The inert gas is used to vigorously rinse the iron bath to intimately mix the sulfur-bearing nickel concentrate and any reductants or slagging agents dissolved in the bath. The rinsing will be continued until maximum transfer of sulfur from the iron bath to the slag is achieved and sulfur equilibrium or quasi-equilibrium between the bath and slag is approached. By quasi-equilibrium is meant the molten iron-slag interfacial movement is sufficient to result in a dynamic balance between the slag and iron bath resulting in chemical and thermal equilibrium conditions being closely approached between the iron and slag.

As will be explained in more detail below, only modest changes are necessary in the melting and/or refining practices used during the manufacture of the nickel-alloyed iron or steel to ensure maximum substitution of Ni from the concentrate for the Ni required for the grade customarily supplied from nickel-bearing scrap and ferronickel. The process of the present invention capitalizes on the presence of under-utilized slag present during the melting and refining of the iron bath with the slag being capable of removing and holding sulfur when the bath and slag are vigorously rinsed. The process of the invention exploits this potential desulfurization capacity as a means to lower the cost of nickel alloying units for producing Ni alloyed stainless steels. The slag sulfur solubility limit normally is not reached during routine refining of stainless steels because the total sulfur load in the refining vessel originating from melting scrap in the electric arc furnace is low, hence the slag desulfurization capacity in the refining vessel is under-utilized. Increased slag weight, residual bath aluminum content and manipulation of slag composition can increase this degree of under-utilization.

The equilibrium slag/metal sulfur partition ratio and the equilibrium slag sulfur solubility determine the maximum sulfur load in the system for a given metal sulfur specification and a given slag weight in a well mixed refining vessel. By manipulation of the slag composition, final metallic aluminum content in an iron bath, slag/metal oxygen potential and temperature, the desulfurization capacity of the slag can be maximized for a given slag weight. This in turn allows the total sulfur load in the system to be maximized. Thus, with knowledge of the equilibrium slag/metal sulfur partition ratio and slag sulfur solubility, the maximum amount of sulfur-bearing nickel concentrate that can be charged into an iron bath for a given sulfur content can be calculated.

Slag sulfur capacity, i.e., $C_s$, can be estimated using optical basicities of slag oxides as defined in the following equation:

$$\log C_s = [(22690-54640\,\Lambda)/T]\Lambda + 43.6\,\Lambda - 25.2, \text{where}$$

the slag optical basicity A is calculated from a molar average of the optical basicity of each oxide $\Lambda_i$, i=oxides A, B . . . :

$\Lambda = X_A\Lambda_A + X_B\Lambda_B$ . . . and where $$X_i = \frac{\text{mole fraction of oxide} \times \text{number of oxygen atoms in oxide molecule}}{\Sigma\text{mole fraction of oxide} \times \text{number of oxygen atoms in oxide molecules}} .$$

The most prevalent oxides in stainless steel slags are CaO, $SiO_2$, $Al_2O_3$ and MgO. Their optical basicities $\Lambda_i$ as determined from the above equation are:

$$\Lambda_{CaO}=1.0;\ \Lambda_{SiO_2}=0.48;\ \Lambda_{Al_2O_3}=0.61 \text{ and } \Lambda_{MgO}=0.78$$

These equations can be combined with standard thermodynamic equations for the sulfur and carbon gas/metal equilibrium and for expressing the effect of metal composition, to calculate the equilibrium distribution of sulfur between slag and steel in a refining vessel. The equilibrium slag/metal sulfur distribution ratio is defined as:

$$L_S \equiv \frac{(\%\ S)}{\%\ \underline{S}} ,$$

where (%S) is the wt. % sulfur in the slag and %$\underline{S}$ is the wt. % sulfur in the iron bath. This ratio can be calculated from the slag/metal sulfur equilibrium:

$$L_S = \frac{C_S f_S}{K_S p_{O_2}^{1/2}} ,$$

where $K_s$ is the equilibrium constant for the equilibrium $$\tfrac{1}{2}S_2(g) = \underline{S}\ \Delta G^\circ = 32{,}280 + 5.6\ T;$$

$f_s$ is the activity coefficient of sulfur dissolved in the iron bath to be calculated below (indefinitely dilute, 1 wt. % reference and standard states, respectively):

$$\log f_s = -0.0280\%S + 0.11\%C + 0.063\%\ Si - 0.011\%\ Cr + 0\%\ Ni - 0.026\%\ Mn - 0.0084\%Cu + 0.01\%N + 0.0027\%Mo + 0.13\%\ B;$$

Cs is the slag sulfur capacity; and $\rho_{o_2}$ is the partial pressure of oxygen (atm).

The slag/metal system generally is not in equilibrium with the $\rho_{o_2}$ of the argon gas. Instead, the $\rho_{o_2}$, is likely to be controlled by one of the oxides, i.e., CO or $Al_2O_3$. If the dissolved carbon-oxygen equilibrium is assumed to hold, then:

$$CO(g) = \underline{C} + \tfrac{1}{2}O_2(g)\ \Delta G^\circ = 32{,}100 + 10.85T$$

$$p_{O_2}^{1/2} = \frac{\exp(-\Delta G^\circ/RT)p_{CO}}{f_C\ \%\ \underline{C}} ,$$

where $$\log f_c = 0.14\%C - 0.024\%Cr + 0.08\%Si + 0.046\%S + 0.012\%Ni - 0.012\%\ Mn + 0.11\%N + 0.016\%Cu - 0.0083Mo\% + 0.24\%\ B;$$

% $\underline{C}$ is wt. % C in the iron bath and $\rho_{co}$ is the partial pressure of CO in the refining vessel, (total pressure of 1 atm assumed), which can be calculated from the $O_2$/Ar ratio of an oxygen blow:

$$p_{CO} = \frac{1}{1 + \frac{1}{2(O_2/Ar)}} .$$

If the prevailing $\rho_{o_2}$ is controlled by the level of dissolved Al, then:

$$2\underline{Al} + \tfrac{3}{2}\theta_2(g) = Al_2O_3(s)\ \Delta G^\circ = -435{,}960 - 3.75T\log T + 92.22T \quad (3)$$

$$\log f\ Al = +0.045\%Al - 0.091\%C - 0.24\%B + 0.0056\%\ Si + 0.04\%\ Cr - 0.017\%\ \text{Ni, where}$$

$$p_{O_2}^{3/2} = \frac{\exp(-\Delta G/RT)}{(f_{Al}\ \%\ \underline{Al})^2} .$$

The equilibrium slag/metal sulfur partition ratio and the equilibrium slag sulfur solubility set the equilibrium, i.e., maximum, allowable total sulfur load in the slag/metal system for a given steel sulfur specification and slag weight. While the slag/metal sulfur partition ratio can be calculated using the equations provided above, slag sulfur solubility is determined directly by measurement. Given the sulfur content of a sulfur-bearing nickel concentrate and the initial sulfur content of the iron bath, the total allowable sulfur load determines the maximum amount of Ni units that can come from the concentrate and still meet the final steel sulfur specification. This is illustrated by the following sulfur mass balance: (Basis: 1 metric tonne alloy)

TOTAL SULFUR OUT=TOTAL SULFUR IN

Slag Sulfur+Steel Sulfur=Concentrate Sulfur+Initial Bath Sulfur

SLAG WT×(%S)+1000×%$S_{spec}$=X+1000×%$S_{Int.\ Bath}$, where $$\frac{(\%\ S)}{\%\ \underline{S}_{spec}} \equiv L_S$$

=the equilibrium slag to metal sulfur distribution ratio, and (%S)≦(%S)$_{max}$, where (%S)$_{max}$ is the sulfur solubility limit in the slag.

The variable X represents the sulfur load from the concentrate addition in units of kg S/tonne steel assuming no loss of sulfur to the furnace atmosphere. For a slag base/acid ratio greater than 2.0 and a dissolved bath aluminum of at least 0.02 wt. %, $L_s$ greater than 200 is calculated.

In some situations, it may be desirable to take advantage of the slag desulfurization capacity and melt solid charge materials for providing the iron bath upstream of the refining vessel in an Electric Arc Furnace (EAF). When a concentrate is charged to and melted in the EAF, the slag composition requirements referred to above should be maintained in the EAF as well. Sulfur equilibrium conditions between the slag and iron bath would be more difficult to achieve in the EAF than in the refining vessel because the prevailing $\rho_{o_2}$ in the EAF is several orders of magnitude higher than in the AOD and mixing conditions are relatively poor. Based on the correlation of slag sulfur capacity with slag optical basicity, the equilibrium slag/metal sulfur distribution $L_s$ is calculated to be only between 10 and 15. Accordingly, the low value of $L_s$ and poor mixing conditions in the refining vessel limit the amount of sulfur-bearing nickel concentrate that can be charged into an EAF to less than the theoretical maximum. Nevertheless, any removal of sulfur by the EAF slag will increase the maximum allowable total sulfur load for the EAF coupled in tandem to a refining vessel since a new slag is created during refining, enabling additional concentrate to be charged above that if just confined to the refining vessel alone. Like the AOD refining vessel, it is desirable for the EAF to include bottom tuyeres to facilitate increased slag/metal contact to transfer sulfur to the slag. The concentrate also should be charged to the EAF in the vicinity of the electrodes where maximum temperature in the furnace occurs, e.g., 1600°–1800° C. This also will facilitate transfer of sulfur to the slag because chemical equilibrium is more easily approached at higher temperatures.

An important feature of the invention is controlling the composition of the slag, i.e., the basicity. Slag basicity is defined as a weight ratio of (% CaO+% MgO)/(% $SiO_2$). This slag basicity should be at least 1.0, preferably at least 1.5 and more preferably at least 2.0. Slag basicity has a big effect on $L_s$ through $C_s$. A slag basicity below 1.0 is detrimental to achieving any significant absorption of sulfur into the slag. Slag basicity should not exceed 3.5 because the slag becomes too viscous at high concentrations of CaO and MgO due to increasing liquidus temperatures.

Another important aspect of the invention includes the addition of a slagging agent such as one or more of CaO, MgO, $Al_2O_3$, $SiO_2$ and $CaF_2$. It may be necessary to use a slagging agent to adjust the slag basicity to the preferable desired ratio. A necessary slagging agent for this purpose is CaO. It also is very desirable to use MgO as a slagging agent. At least 12 wt. % of MgO is preferred for the slag to be compatible with MgO in the refractory lining of the refining vessel. Preferably, the MgO in the slag should not exceed 20 wt. % because the increasing liquidus temperature due to higher MgO levels will make the slag viscous and difficult to mix with the metal bath. It also is desirable to add up to 10 wt. % fluorspar ($CaF_2$) to the slag because it increases slag fluidity, assisting in solution of lime and sulfur. When $Al_2O_3$ is present in the slag, it preferably should not exceed about 20–25 wt. % because $Al_2O_3$ adversely affects $C_s$. It is desirable for the final slag to contain at least 15 wt. % $Al_2O_3$ to promote slag fluidity.

Another important feature of the invention is controlling the ratio of the amount of the final slag weight divided by the iron bath weight contained in the refining vessel, i.e., (kg slag)/(kg bath). This slag weight ratio preferably should be at least 0.10 and more preferably at least 0.15. At least 0.10 is desirable to remove significant sulfur from the slag. On the other hand, this slag weight ratio should not exceed 0.30 because effective mixing of the bath becomes very difficult. In those situations where a large slag quantity is generated and the upper limit of the weight ratio is exceeded, a double slag practice should be used to maximize the total amount of sulfur that can be removed by slag, yet achieve adequate mixing of the bath and closely approach chemical equilibrium conditions.

Other compositions during the course of using the invention may be controlled as well. The inert gases for passage through the bottom tuyere for rinsing the iron bath that may be used in the invention during the reduction period include argon, nitrogen and carbon monoxide. Argon especially is preferred when its purity level is controlled to at least 99.997 vol. %. The reason for this extreme purity is because oxygen introduced with argon as low as 0.0005 vol. % represents a higher $p_{o2}$ than occurring in the refining vessel from the equilibrium of dissolved aluminum and carbon in the iron bath, i.e., $Al/Al_2O_3$ or C/CO.

The present invention is desirable for supplying Ni alloying units for producing austenitic steels containing ≦0.11 wt. % C, ≦2.0 wt. % Al, ≦2.0 wt. % Si, ≦9 wt. % Mn, ≦0.03 wt. % S, ≦26 wt. % Cr and ≦20 wt. % Ni. The process is especially desirable for producing austenitic AISI 304, 12 SR and 18 SR stainless steels. Aluminum and silicon are very common reductants dissolved in the iron bath when refining stainless steel during the reduction period when the high purity inert mixing gas is introduced. During refining, some of the valuable Cr units become oxidized and lost to the slag. A bath reductant reduces chromium oxide in the slag and improves the yield of metallic Cr to the bath. The final aluminum bath level for AISI 301–306 grades should not exceed 0.02 wt. % because of the deleterious effect of Al on weldability of the steel. However, the final aluminum bath level for other stainless steel grades that are not welded such as 12 SR and 18 SR can be as high as about 2 wt. %. Nickel is an important alloying metal contributing to the formation of austenite in stainless steel. These steels contain at least 2 wt. % Ni and preferably at least 4 wt. % Ni. Table I gives the chemistry specification in 25 wt. % for the AISI 301–06 grade.

TABLE I

| | S | C | Cr | Ni | Si | Mn | P | Mo | Cu | $N_2$ | Al |
|---|---|---|---|---|---|---|---|---|---|---|---|
| Max | 0.025 | 0.05 | 18.0 | 6.25 | 0.7 | 2.75 | 0.04 | 0.5 | 0.5 | 0.16 | 0.02 |
| Min | 0.015 | 0.03 | 17.5 | 5.75 | 0.3 | 2.25 | low | low | — | 0.12 | — |
| Aim | 0.018 | 0.04 | 17.7 | 6.0 | 0.5 | 2.5 | low | low | 0.4 | 0.14 | — |

In a conventional steel manufacturing operation employing an EAF and AOD in tandem, most of the Ni and Cr units required are contained in the scrap initially melted in the EAF to provide the iron bath for subsequent refining in the AOD. For a 6 wt. % nickel containing Cr—Ni alloyed stainless steel, up to about 5 wt. % of the Ni can come from nickel containing scrap, metallic Ni shot or metallic Ni cones melted in the EAF charge materials. The remaining 1 wt. % or so of nickel comes from Ni shot or cones used as trim in the AOD. Generally, solid scrap and burnt lime are charged into and melted in the EAF over a period of 2 to 3 hours. The EAF charge materials also would include a source of Cr units as well. Acceptable chromium sources include chromium-containing scrap and ferrochromium. Solution of the lime into the iron bath forms a basic slag. Conventional bath and slag wt. % analysis after melting the iron bath in the EAF for making a Cr—Ni stainless steel is:

Bath: 1.2% C; 0.2% Si; 16.5% Cr; 6.5% Ni; 0.5%S, 0.75% Mn

Slag: 31.2% CaO; 33.0% $SiO_2$; 5.8% $Al_2O_3$; 8.3% MgO, 5.7% $Cr_2O_3$

The calculated slag basicity ratio for this analyses is 1.2.

The iron bath is tapped from the EAF, the slag is discarded and the bath is transferred to a refining vessel such as an AOD. After the iron bath is charged to the refining vessel, decarburization occurs by passing an oxygen-containing gas through the tuyere. After decarburization, ferresilicon and aluminum shot are added to the bath to improve Cr yield during rinsing with high purity argon. Thereafter, any alloy trim additions such as ferronickel, Ni shot or ferrochrome, may be added to the bath to make the alloy specification.

After an iron bath is transferred to an AOD or TBRR from an EAF, chromite may be added to the bath, with the refining vessel also being used for smelting to reduce the chromite for recovering Cr units. Sulfur-bearing nickel concentrate can be added along with the chromite. In this case, the slag weight can be considerably larger, up to 0.3 kg slag/kg iron bath. After smelting followed by decarburization to the carbon specification, the bath is rinsed with an inert gas wherein ferrosilicon and/or aluminum are added to the iron bath for recovering Cr from the slag to improve Cr yield and to maximize desulfurization.

EXAMPLE

The following example illustrates an application of the present patent invention for making AISI grade 301–06 stainless steel using an EAF and an AOD in tandem. Three key scenarios are considered:

I. A one-slag practice at 106 kg slag per tonne stainless steel,

II. A one-slag practice at 210 kg slag per tonne stainless steel and

III. A two-slag practice, each slag at 106 kg slag per tonne stainless steel.

Case I provides a ratio of slag weight (kg) to bath weight (kg) of 0.11 and Case II provides a ratio of slag weight (kg) to bath weight (kg) of 0.21. After solid charge materials are melted in the EAF at a temperature of least 1550° C., the iron bath is transferred to the AOD refining vessel. Preferably, the bath temperature is heated in the EAF to at least 1600° C. and maintained between 1600°–1650° C. The temperature should not exceed 1700° C. because higher temperatures would be detrimental to the integrity of the refractory lining in the EAF. Normally, excess carbon will be dissolved in the iron bath. Decarburization commences with oxygen being injected with argon, beginning at a ratio of $O_2$/Ar of 4/1 which is stepped down to a ratio of 1/1 over approximately a 30 minute period. The AOD is sampled, then the decarburizing blow continues for another 10 minutes, at a ratio of $O_2$/Ar of ⅓. After decarburization is completed, an inert gas rinse using a technical grade of argon having a purity of at least 99.998% is used. At the beginning of the argon rinse, ferrosilicon and aluminum shot are added to the bath to improve Cr yield. Alloy nickel trim additions could be made at the end of the argon rinse.

The absence of oxygen during the argon vigorous rinsing marks the period where the slag/metal sulfur distribution is at its highest level. This is mainly due to a diminished partial pressure of oxygen in the AOD atmosphere. Aluminum added to the bath also reduces the oxygen partial pressure associated with the equilibrium between aluminum dissolved in the bath and alumina dissolved in the slag. During this reduction stage, the slag would have the composition in wt. % shown in Table II:

TABLE II

| CaO | $SiO_2$ | $Al_2O_3$ | MgO | $Cr_2O_3$ | MnO | FeO | Tio | F |
|---|---|---|---|---|---|---|---|---|
| 45.0 | 31.0 | 4.0 | 13.0 | 3.0 | 1.5 | 0.5 | 0.3 | 1.8 |

Mass balance calculations are made for a base operation for which the slag basicity, (% CaO+MgO)/% $SiO_2$=1.9 and aim % Al in the bath is 0.0035%, and for a higher slag basicity of 3.5 in combination with a higher final % Al of 0.02%. All calculations are made for a slag sulfur solubility level, $(\%S)_{max.}$, of 4 wt. %. This constraint may not be active in the calculation, depending on the slag to metal sulfur partition ratio, $L_s$, and on the sulfur specification of the alloy to be produced. The sulfur specification is for AISI 301–06 grade at 0.02% S for all calculations. The sulfur-bearing nickel concentrate is assumed to have 28% Ni, 35% Fe, 30% S, 0.15% Cu and 0.5% Co. Based on analysis of operating data for refining AISI 304 stainless steel in an AOD where the slag basicity was 1.9 and the final bath Al was 0.0035 wt. %, $L_s$ was found to be 130. With sufficient rinsing of the bath, $L_s$ is expected to increase to as much as 1100 by increasing slag basicity to 3.5 and bath Al to 0.02 wt. %. The results of the sulfur balance calculations are presented in Table III.

TABLE III

| | (% S)max. = 4% | | | | |
|---|---|---|---|---|---|
| Scenario | (% S) | $L_s$ | kg S/ tonne | kg Ni/ tonne | % Ni |
| Case I - One-slag practice (106 kg slag/tonne) (A) B/A = 1.9 and % Al = 0.0035 | 2.6 | 130 | 2.5 | 2.3 | 0.26 |
| Case I - One-slag practice (106 kg slag/tonne) (B) B/A = 3.5 and % Al = 0.02 | 4.0 | 1100 | 3.8 | 3.6 | 0.39 |
| Case II - One-slag practice (210 kg slag/tonne) (A) B/A = 1.9 and % Al = 0.0035 | 2.6 | 130 | 5.0 | 4.6 | 0.51 |
| Case II - One-slag practice (210 kg slag/tonne) (B) B/A = 3.5 and % Al = 0.02 | 4.0 | 1100 | 7.7 | 7.2 | 0.79 |
| Case III - Two-slag practice (106 kg each) (A) B/A = 1.9 and % Al = 0.0035 | 4/2.6 | 130 | 6.3 | 5.9 | 0.65 |
| Case III - Two-slag practice (106 kg each) (B) B/A = 3.5 and % Al = 0.02 | 4/4 | 1100 | 7.6 | 7.1 | 0.79 |

Table III indicates the potential range of nickel units for a Cr—Ni alloy steel obtainable from a 28% Ni–30% S concentrate charged to the AOD prior to the refining period, depending on aim dissolved % Al and slag practice. Without any change in process conditions, this is estimated to be about 2.3 kg Ni per tonne stainless steel (Case I-A). While increasing slag basicity and aim % Al to grade specification increases $L_s$ substantially, the slag sulfur solubility becomes limiting when $L_s$ increases to only 200 for a final sulfur specification of 0.02% S. Cases II and III show the benefits of increased slag weight as kg slag/kg bath, whether as a one-slag practice with a doubling in weight, or as a two-slag practice, where the total slag weight is the same for the two cases. When $L_s$ exceeds 200, the slag sulfur solubility is limiting, but the higher slag weight permits a higher sulfur load and thus a larger addition of the sulfur-bearing Ni concentrate.

Upon increasing the slag basicity in the EAF from 1.9 to 3.5, and increasing slag weight there to 150 kg slag per tonne stainless steel, the potential Ni units shown in Table II can be increased theoretically by about 2.5 kg per tonne stainless steel. However, this will require mixing in the EAF by bottom mixing to facilitate approaching chemical equilibrium between the metal and slag phases with respect to sulfur.

Dissolution of nickel and iron sulfides from a sulfur-bearing nickel concentrate is mildly exothermic, where the heat released contributes to the sensible heat requirement for the concentrate charged cold. However, less than 50 kg concentrate per tonne stainless steel is charged, moderately impacting the heat balance.

It will be understood various modifications can be made to the invention without departing from the spirit and scope of it. Therefore, the limits of the invention should be determined from the appended claims.

What is claimed is:

1. A method for manufacturing a nickel-alloyed iron or steel in a refining vessel including a bottom tuyere, comprising:

providing an iron based bath covered by a slag in the refining vessel, the bath including a sulfur-bearing Ni concentrate and a reductant, the concentrate containing >2.6 wt. % S, passing an inert gas through the bottom tuyere to vigorously rinse the bath to intimately mix the concentrate and the reductant with the bath, and continue rinsing the bath until maximum transfer of sulfur from the bath to a final slag is achieved and dynamic equilibrium is approached whereby the bath becomes alloyed with nickel and contains ≦0.03 wt. % S.

2. The method of claim 1 wherein the weight ratio of the slag weight to the bath weight is at least 0.10.

3. The method of claim 1 wherein the weight ratio of the slag weight to the bath weight is no greater than 0.30.

4. The method of claim 1 including the additional step of passing an oxygen gas through the bottom tuyere to remove excess carbon from the bath prior to adding the reductant and rinsing with the inert gas.

5. The method of claim 1 wherein the initial slag basicity is at least 1.0.

6. The method of claim 1 wherein the initial slag basicity is no greater than 3.5.

7. The method of claim 1 wherein the final slag contains 15–25 wt. % $Al_2O_3$.

8. The method of claim 1 wherein the final slag contains 12–20 wt. % MgO.

9. The method of claim 1 wherein the final slag contains no more than 10 wt. % $CaF_2$.

10. The method of claim 1 wherein the bath includes one or more slagging agents selected from the group consisting of CaO, MgO, $Al_2O_3$, $SiO_2$ and $CaF_2$.

11. The method of claim 1 including a step of adding the concentrate to the bath in an electric arc furnace.

12. The method of claim 1 including the additional steps of adding solid charge materials to an electric are furnace, the charge materials including ferrous scrap and a slagging agent selected from the group consisting of CaO, MgO, $Al_2O_3$, $SiO_2$ and $CaF_2$, melting the charge materials to form the iron bath, transferring the bath to the vessel, adding the concentrate to the bath in the refining vessel, and passing an oxygen gas through the bottom tuyere to decardurize carbon from the bath until a final carbon specification is obtained prior to rinsing with the inert gas.

13. The method of claim 1 wherein chromite is added to the bath prior to rinsing with the inert gas.

14. The method of claim 1 including the additional steps of adding solid charge materials to an electric are furnace, the charge materials including ferrous scrap, the concentrate and a slagging agent selected from the group consisting of CaO, MgO, $Al_2O_3$, $SiO_2$ and $CaF_2$, melting the charge materials to form the iron bath having a temperature at least 1550 C, and transferring the iron bath to the refining vessel.

15. The method of claim 1 wherein the bath contains chromium and including a step of adding an additional source of nickel selected from the group consisting of ferronickel or nickel shot during the rinsing step.

16. The method of claim 15 wherein the nickel-alloyed bath contains ≦2.0 wt. % Al, ≦2.0 wt. % Si, ≦0.03 wt. % S, ≦26 wt. % Cr and 0.05–20 wt. % Ni.

17. The method of claim 1 wherein the reductant is selected from the group consisting of aluminum, silicon, titanium, calcium, magnesium and zirconium.

18. The method of claim 1 wherein the bath temperature is at least 1550° C. during rinsing.

19. The method of claim 18 wherein the bath temperature is 1600°–1700° C.

20. The method of claim 1 wherein the concentrate contains one or more sulfides of iron, copper and nickel.

21. The method of claim 1 wherein the nickel-alloyed bath contains ≦26 wt. % Cr and ≧0.05 wt. % Ni.

22. A method for manufacturing a nickel-alloyed stainless steel in a refining vessel including a bottom tuyere, comprising:

providing an iron bath covered by a slag having a basicity of at least 1.5 in the refining vessel, the ratio of the slag weight to the bath weight being at least 0.10, the bath including a sulfur-bearing Ni concentrate containing >2.6 wt. % S, passing an oxygen gas through the bottom tuyere to decarburize carbon from the bath until a final carbon specification is obtained, adding a reductant to the bath, passing an inert gas through the bottom tuyere to vigorously rinse and intimately mix the concentrate and the reductant with the bath and the slag, and continue rinsing the bath with the inert gas until maximum transfer of sulfur from the bath to a final slag is achieved and dynamic equilibrium is approached whereby a final bath containing ≦0.03 wt. % S and with ≧0.05 wt. % nickel is produced.

23. A method for manufacturing a nickel-alloyed stainless steel in a refining vessel including a bottom tuyere, comprising:

melting a solid charge into a molten iron bath in an electric arc furnace at a temperature of at least 1550° C., the charge including ferrous scrap, a sulfur-bearing nickel concentrate and a slagging agent, the concentrate containing >2.6 wt. % S, the iron bath covered by a slag having a basicity of at least 1.5 and the ratio of the slag weight to the bath weight being at least 0.10, transferring the bath to the refining vessel, passing an oxygen gas through the bottom tuyere to decarburize carbon from the bath until a final carbon specification is obtained, adding a reductant to the bath, and passing an inert gas through the bottom tuyere to vigorously rinse the bath to mix the concentrate and the reductant until maximum transfer of sulfur from the bath to a final slag is achieved and dynamic equilibrium is approached whereby a final bath of a stainless steel composition containing ≦2.0 wt. % Al, ≦2.0 wt. % Si, ≦0.03 wt. % S, ≦26 wt. % Cr and 0.05–20 wt. % Ni is produced.

* * * * *